US008322467B2

(12) United States Patent
Shen et al.

(10) Patent No.: US 8,322,467 B2
(45) Date of Patent: Dec. 4, 2012

(54) CUTTING ELEMENT HAVING STRESS REDUCED INTERFACE

(75) Inventors: Yuelin Shen, Houston, TX (US); John (Youhe) Zhang, Tomball, TX (US)

(73) Assignee: Smith International, Inc., Houston, TX (US)

( * ) Notice: Subject to any disclaimer, the term of this patent is extended or adjusted under 35 U.S.C. 154(b) by 440 days.

(21) Appl. No.: 11/867,611

(22) Filed: Oct. 4, 2007

(65) Prior Publication Data

US 2009/0090562 A1 Apr. 9, 2009

(51) Int. Cl.
*E21B 10/52* (2006.01)
*B23K 31/12* (2006.01)

(52) U.S. Cl. ..... 175/434; 228/104

(58) Field of Classification Search ..... 175/426, 175/431

See application file for complete search history.

(56) References Cited

U.S. PATENT DOCUMENTS

| | | | | |
|---|---|---|---|---|
| 4,511,006 | A * | 4/1985 | Grainger | 175/57 |
| 5,947,216 | A * | 9/1999 | Truax et al. | 175/432 |
| 6,003,623 | A * | 12/1999 | Miess | 175/430 |
| 6,196,340 | B1 | 3/2001 | Jensen et al. | |
| 6,367,568 | B2 * | 4/2002 | Steinke et al. | 175/331 |
| 6,604,588 | B2 * | 8/2003 | Eyre et al. | 175/374 |
| 2002/0084112 | A1 | 7/2002 | Hall et al. | |
| 2006/0201712 | A1 * | 9/2006 | Zhang et al. | 175/57 |
| 2006/0254830 | A1 * | 11/2006 | Radtke | 175/426 |

FOREIGN PATENT DOCUMENTS

| | | |
|---|---|---|
| GB | 2380211 | 4/2003 |
| GB | 2427215 | 12/2006 |
| GB | 2433525 | 6/2007 |

OTHER PUBLICATIONS

Search Report for GB0818026.7 dated Feb. 9, 2009, total 4 pages.

* cited by examiner

*Primary Examiner* — Kenneth L Thompson
*Assistant Examiner* — James Sayre
(74) *Attorney, Agent, or Firm* — Connolly Bove Lodge & Hutz LLP

(57) ABSTRACT

Cutting elements include an ultra-hard body, e.g., comprising diamond, that is attached to substrate, e.g., comprising a cermet. An interface exists between the body and the substrate, and an angle of departure as measured between the interface and a free edge of the cutting element within one or both of the body and substrate, is less than about 90 degrees to provide a desired stress reduction along the interface. The angle of departure can be from about 3 to 87 degrees. The desired reduced angle of departure is provided by a surface feature disposed along an outer side surface of the cutting element adjacent a free edge of the interface. The surface feature can in the form of a groove disposed circumferentially around the body and/or substrate outer side surface, that is configured to provide the desired reduced angle of departure within the body and/or substrate.

13 Claims, 3 Drawing Sheets

CUTTING ELEMENT HAVING STRESS REDUCED INTERFACE

FIELD OF THE INVENTION

This invention relates to cutting elements comprising an ultra-hard region attached to a substrate and, more particularly, to cutting elements having an interface between the ultra-hard region and substrate that has been specifically engineered to reduce the stresses that occur near a free edge of the interface.

BACKGROUND OF THE INVENTION

The use of cutting elements comprising an ultra-hard body formed from an ultra-hard material such as diamond, polycrystalline diamond (PCD), thermally-stable polycrystalline diamond (TSP), cubic boron nitride (cBN), polycrystalline cubic boron nitride (PcBN) and the like, that is attached to a substrate formed from metallic or cermet materials is well known in the art. For example, cutting elements that are configured for use with bits for drilling subterranean formations are known to comprise an ultra-hard body that is formed from PCD or TSP and that is attached to a substrate formed from cemented tungsten carbide (WC—Co).

Where the cutting element comprises a PCD body, such is typically attached to the substrate during the high pressure/high temperature (HPHT) process used to sinter the body. Alternatively, the PCD body can be attached to the substrate subsequent to it being sintered by welding or brazing or the like. Where the cutting element comprises a TSP body, the body is typically attached to the substrate, after the diamond body has both been sintered and rendered thermally stable, by welding or brazing process.

A feature that is common to such known cutting elements is the presence of a joint that exists between interfacing surfaces of two materials, i.e., the ultra-hard body and the substrate, that have different elastic and thermal expansion properties. In is well known that the joint in such cutting elements can be subject to large amounts of stress during use of the cutting element caused by the existence of such elastic and thermal expansion property differences between the joined together materials. This stress is known to cause cracking and/or delamination at the joint, between the ultra-hard body and the substrate, that can cause the cutting element to fail, thereby reducing the desired cutting element service life.

Past attempts to address this issue have focused on the entirety of the interfacing surfaces between the ultra-hard body and substrate, and have involved changing the geometry of the interfacing surfaces from having a planar interface to having a nonplanar interface geometry. Such nonplanar interface geometries have generally been achieved by configuring both interfacing surfaces to include one or more complementary surface features that would provide a desired nonplanar interface therebetween.

While such attempts have some effect in reducing some of the stresses existing along the interface between the ultra-hard body and substrate, under certain conditions, it is difficult to make a cutting element with a desired non-planar interface to suppress such stress. For example, it is much more difficult to braze a TSP with non-planar interface to the substrate.

It is, therefore, desired that a cutting element be constructed in a manner that is calculated to reduce and/or eliminate unwanted stresses that can exist at the joint between the ultra-hard body and the substrate, and more specifically, to reduce and/or eliminate the stresses that can exist at the free edge of the interface. It is further desired that such cutting element be constructed in a manner that does not involve exotic materials and/or complex manufacturing techniques.

SUMMARY OF THE INVENTION

Cutting elements prepared according to principals of this invention comprise a ultra-hard body formed from a material selected from the group consisting of diamond, polycrystalline diamond, thermally stable polycrystalline diamond, cubic boron nitride, polycrystalline cubic boron nitride, and combinations thereof. A substrate is attached to the ultra-hard body is formed from material having different mechanical or thermal properties than that of the ultra-hard body. An interface exists between the body and the substrate.

Cutting elements are configured having an angle of departure, as measured between the interface and a free edge of the cutting element, in one or both of the body and substrate that is less than about 90 degrees. In an example embodiment, the angle of departure in one or both of the body and substrate can be in the range of from about 3 to 87 degrees, preferably in the range of from about 30 to 85 degrees, and more preferably in the range of from about 45 to 75 degrees.

In an example embodiment, the desired angle of departure is provided by the use of surface feature that is provided along an outer side surface of the cutting element adjacent a free edge of the interface. The surface feature can be provided along the body, to obtain the desired angle of departure within the body, or along the substrate, to obtain the desired angle of departure within the substrate, or surface features can be provided along both the body and the substrate to obtain the desired angle of departures within both the body and substrate. In an example embodiment, the surface feature can be provided in the form of a groove that is disposed circumferentially around the body and/or substrate outer side surface and that is configured to provide the desired reduced angle of departure.

The surface feature can be formed by pressing or by machining techniques, and can be formed before or after the body and substrate have been joined together. An intermediate material can be used to attach the body to the substrate.

Cutting elements comprising such feature can be used in such applications as with bits for drilling subterranean formations, where properties of reduced stress singularity is desired for the purpose of extending the effective service life of the cutting element.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Cutting elements constructed in accordance with the principles of this invention comprise an ultra-hard body that is attached or joined to a desired substrate, and that further comprises a desired interface geometry located adjacent a free edge of the interface that is calculated to reduce and/or eliminate the stresses that can occur at this region when the cutting element is subjected to mechanical and/or thermal loading, i.e., during end-use application. Such cutting elements have been configured such that an angle between the free edge and the interface within one or both of the body and the substrate is less than 90 degrees. The angles are achieved by adjusting the free edge, either during the initial sintering process or through machining at the final stage.

Figure 1:
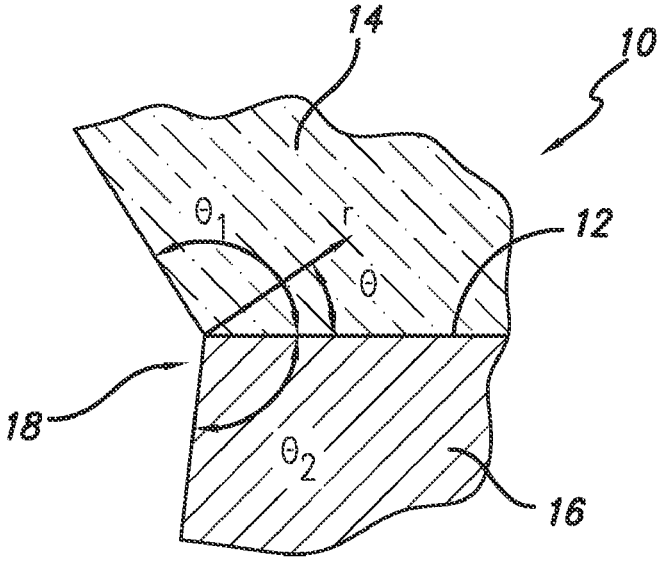
FIG. 1 is a cross-sectional side view illustrating a portion of a cutting element near a free edge of an interface between an ultra-hard body and a substrate.

FIG. 1 illustrates a section taken from a conventional cutting element 10 showing an interface 12 that exists between two different materials 14 and 16, e.g., between a ultra-hard body 14 and a substrate 16, adjacent a free edge 18 of the cutting element 10. The stress near the free edge of the interface can be modeled according to the equation presented below:

$$\sigma_{ij}(r,\theta)=\sum_{K=0}^{N} r^{-\lambda_k} K_k f_{ijk}(\theta) \quad (i,\ j=1,2,3)$$

Where r and θ are the polar coordinates, $f_{ijk}(\theta)$ is an angular function, and $K_k$ is a stress intensity factor. Both of them are determined by material properties and by wedge angles $\theta_1$ and $\theta_2$ of the two joining materials. For a joint or interface with two determined materials, the stress singularity order λ can be changed by varying $\theta_1$ and $\theta_2$.

Using this model it has been determined that for an interface or joint between two different materials, the stress or stress singularity at the interface can be changed by varying the wedge angles or angles of departure $\theta_1$ and $\theta_2$ that exist between the interface and the free edge in either one or both of the materials.

For conventional cutting elements, such as those formed having a PCD body or TSB body that is attached to a substrate by sintering process or by brazing, that have an interface or joint of the two materials adjacent the interface free edge where $\theta_1$ and $\theta_2$ are each 90 degrees, a band of high stress exists along the interface adjacent the free edge or side surface. The band of high stress in this region in such a conventional cutting element is formed after the cutting element has been manufactured and when it is subjected to mechanical and/or thermal loading, e.g., when used in a drill bit under drilling loads, and is due to stress singularity at this region.

The presence of such band of high stress can cause cracks to initiate at this area within the cutting element between the two materials, and can ultimately cause the interface or joint between the two materials to fail by delamination.

Figure 2:
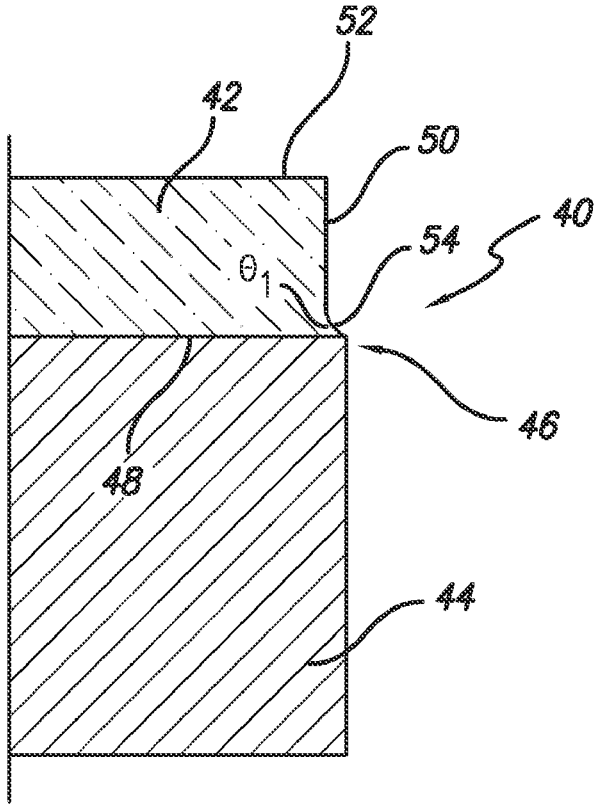
FIG. 2 is a cross-section side view illustrating another cutting element embodiment.

FIG. 2 illustrates a cutting element embodiment 40 comprising an ultra-hard body 42 that is attached to a substrate 44, wherein the materials used to form the ultra-hard body and substrate in this cutting element can be the same as those described above for forming conventional cutting elements. In an example embodiment, the ultra-hard body is formed from TSP and the substrate is formed from WC—Co. In this particular embodiment, the ultra-hard body 42 has been joined to the substrate 44 through the use of a braze material or the like. In this particular embodiment, the stress singularity was reduced by changing an angle of departure with the interface between the body and substrate to less than 90 degrees within the body by changing the geometry of a free surface or side surface 46 of the cutting element adjacent the interface 48.

In this particular embodiment, a side surface 46 of the ultra-hard body 42 has been configured to provide a desired angle of departure $\theta_1$ of less than 90 degrees within the cutting element, and more particularly within the ultra-hard body 42. In this example, ultra-hard body 42 has a side surface having a first diameter section 50 moving downwardly away from a top surface 52 of the body, which first diameter section is constant until the side surface approaches the interface 48. As the side surface approaches the interface 48, the diameter of the body gradually increases until it matches the diameter of the underlying substrate at the interface.

Figure 3:
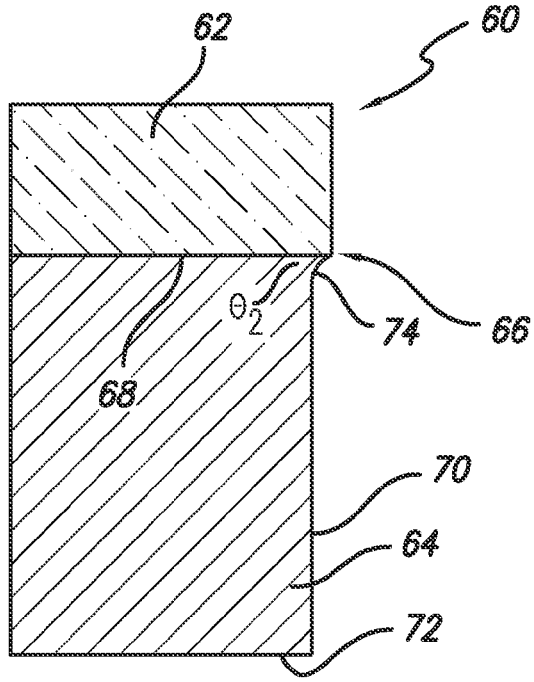
FIG. 3 is a cross-section side view illustrating another cutting element embodiment.

As illustrated in FIG. 3, this gradual increase in side surface diameter produces an outwardly flared region 54 that can either have a curved exterior geometry, i.e., defined by a radius, or a planar exterior geometry, i.e., defined by an angle. When viewing the entire cutting element, the outwardly flared region 54 extends as an annular section of the body side surface adjacent the interface.

A feature of the ultra-hard body side surface configured in this matter is that the presence of the outwardly flared region 54 operates to reduce the angle of departure $\theta_1$ within the ultra-hard body between the interface 48 and the side surface 46 to less than 90 degrees, and thereby reduce the stress singularity of the resulting cutting element. The angle of departure, and/or the particular geometry of the outwardly flared region, that is provided according to this embodiment reflects a consideration of both what is useful for reducing the stress singularity as noted above, as well as any impact that such change to the outer surface geometry of the cutting element could have on the cutting element performance and/or service life. The desired configuration of the ultra-hard body side surface can be provided during sintering or by machining.

While the embodiment in FIG. 2 has been illustrated and described as having an ultra-hard body comprising a first diameter section and a flared region, it is to be understood that the desired angle of departure $\theta_1$ of being less than 90 degrees can be achieved through a combination of other side surface features. For example, the ultra-hard body side surface could be configured having a single radiused groove removed therefrom that is positioned adjacent the interface free edge. It is, therefore, to be understood that side surface features and geometries other than those disclosed herein, and that operate to provide an angle of departure $\theta_1$ of less than 90 degrees, are understood to be within the scope of this invention.

In an example embodiment, it is desired that the angle of departure $\theta_1$ can be within the range of from about 3 to 87 degrees, preferably in the range of from about 30 to 85 degrees, and more preferably in the range of from about 45 to 75 degrees. It is to be understood that the exact angle for the angle of departure $\theta_1$ can and will vary depending on the types of materials used to form both the ultra-hard body and substrate, the types of materials that are used to join the ultra-hard body and substrate together, and the particular end-use application. In such example embodiment, the flared region has a radiused exterior profile. The angle of departure $\theta_2$ in this example embodiment is approximately 90 degrees.

FIG. 3 illustrates another example embodiment cutting element 60 comprising an ultra-hard body 62 that is attached to a substrate 64, wherein the materials used to form the same can be the same as those noted above. Unlike the cutting element embodiment of FIG. 2, in this embodiment the substrate 64 is constructed having a side surface 66 that is configured adjacent a free edge of the interface 68.

In this particular embodiment, a side surface 66 of the substrate 64 has been configured to provide a desired angle of departure $\theta_2$ of less than 90 degrees within the cutting element. In this example, substrate 64 has a side surface having a first diameter section 70 moving upwardly away from a bottom surface 72 of the substrate, which first diameter section is constant until the side surface approaches the interface 68. As the side surface approaches the interface 68, the diameter of the substrate gradually increases until it matches the diameter of the overlying ultra-hard body 62 at the interface.

As illustrated in FIG. 3, this gradual increase in side surface diameter produces an outwardly flared region 74 that can either have a curved exterior geometry, i.e., defined by a radius, or a planar exterior geometry, i.e., defined by an angle. When viewing the entire cutting element, the outwardly flared region 74 extends as an annular section of the substrate side surface adjacent the interface.

A feature of the substrate side surface configured in this matter is that the presence of the outwardly flared region 74 operates to reduce the angle of departure $\theta_2$ within the substrate between the interface and the side surface to less than 90 degrees, and thereby reduce the stress singularity of the resulting cutting element. The angle of departure, and/or the particular geometry of the outwardly flared region, that is provided according to this embodiment reflects a consideration of both what is useful for reducing the stress singularity as noted above, as well as the any change to the outer surface geometry of the cutting element could have on the cutting element performance and/or service life. The desired configuration of the substrate side surface can be provided during sintering or by machining.

While the embodiment in FIG. 3 has been illustrated and described as having a substrate comprising a first diameter section and a flared region, it is to be understood that the desired angle of departure $\theta_2$ of less than 90 degrees can be achieved through a combination of other side surface features. For example, the substrate side surface could be configured having a single radiused groove removed therefrom that is positioned adjacent the interface free edge. It is, therefore, to be understood that side surface features and geometries other than those disclosed herein, and that operate to provide an angle of departure $\theta_2$ of less than 90 degrees, are understood to be within the scope of this invention.

In an example embodiment, it is desired that the angle of departure $\theta_2$ can be within the range of from about 3 to 87 degrees, preferably in the range of from about 30 to 85 degrees, and more preferably in the range of from about 45 to 75 degrees. It is to be understood that the exact angle for the angle of departure $\theta_2$ can and will vary depending on the types of materials used to form both the ultra-hard body and substrate, the types of materials that are used to join the ultra-hard body and substrate together, and the particular end-use application. In such example embodiment, the flared region has a radiused exterior profile.

The selection of the particular form of geometry that is used to achieve the reduced angle of departure depends on such factors as the particular end-use application, and the manufacturing costs of making the cutting element. For example, the surface feature can be added to the ultra-hard body sidewall surface so it does not introduce any changes to the configuration or method for making an end-use device configured to accommodate the same, such as a drill bit or the like. The surface feature may also be added to the substrate sidewall surface, for example, if it is most cost effective to reduce the machining costs associated with forming the desired cutting element because the substrate is easier and more cost effective to machine than the ultra-hard body.

Figure 4:
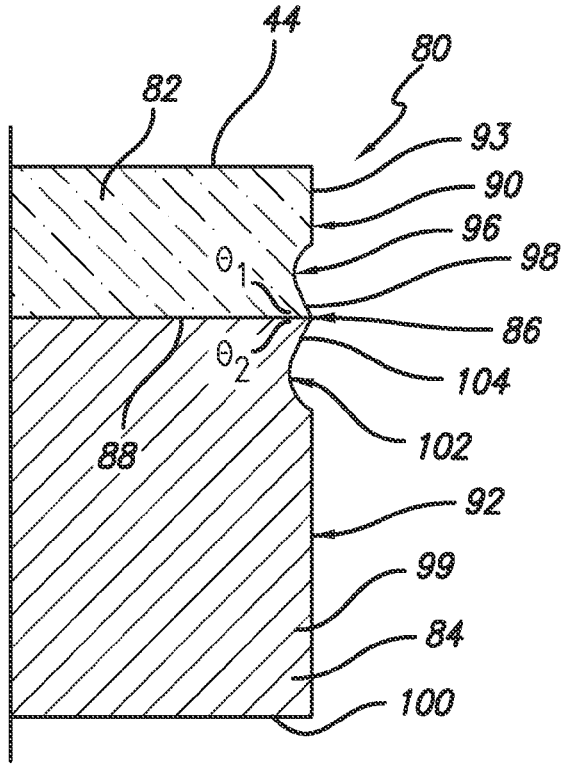
FIG. 4 is a cross-section side view illustrating another cutting element embodiment.

FIG. 4 illustrates a still other cutting element embodiment 80 comprising an ultra-hard body 82 that is attached to a substrate 84, wherein the materials used to form the same can be the same as those noted above. Like the embodiments illustrated in FIGS. 2 and 3, the stress in this embodiment is reduced by reducing the internal angle of departure to below 90 degrees by changing the geometry of the side surface 86 adjacent the free edge of the interface 88 of the cutting element.

In this particular embodiment, side surface portions 90 and 92 of both the respective ultra-hard body 82 and the substrate 84 have been configured to provide desired angles of departure $\theta_1$ within the body and $\theta_2$ within the substrate that are each less than 90 degrees from the interface 88. The ultra-hard body 82 is configured with a side surface, having a first diameter section 93 that extends downwardly from a top surface 94 towards the interface 88. A groove 96 extends radially inwardly a distance from the first diameter section and includes a flared region 98 that projects radially outwardly from an innermost portion of the groove and that extends axially to the free edge of the interface. The groove 96 can be defined by a single radius or can be define by one or more different radiused sections. In an example embodiment, the groove is defined by a straight line and a radius tangent to each other. In an example embodiment, the flared region 98 has an outermost diameter that is substantially the same as the first diameter section, and that is substantially the same as an underlying portion of the substrate 84.

The substrate 84 is configured with a side surface, having a first diameter section 99 that extends upwardly from a bottom surface 100 towards the interface 88. A groove 102 extends radially inwardly a distance from the first diameter section and includes a flared region 104 that projects radially outwardly from an innermost portion of the groove and that extends axially to the free edge of the interface. Like the groove noted above in the ultra-hard body, the groove 102 can be defined by a single radius or can be defined by one or more different radiused sections. In an example embodiment, the groove 102 is defined by a straight line and a radius tangent to each other. In an example embodiment, the flared region 104 has an outermost diameter that is substantially the same as the first diameter section, and that is substantially the same as an overlying portion of the ultra-hard body 82.

A feature of this cutting element embodiment 80 is that the presence of the grooves 96 and 102 in the respective side surfaces of the ultra-hard body 82 and substrate 84 operates to reduce the respective angles of departure $\theta_1$ and $\theta_2$ within each of the ultra-hard body and the substrate to less than 90 degrees, thereby reducing the stress singularity of the resulting cutting element. The angle of departure, and/or the particular geometry of the grooves and the respective flared region, that is provided according to this embodiment reflects a consideration of what is useful for reducing the stress singularity as noted above, as well any impact such change to the outer surface geometry of the cutting element could have on the cutting element performance and/or service life. The desired configuration of the hard-body and substrate side surfaces can be provided during sintering or by machining.

While the embodiment in FIG. 4 has been illustrated and described as having an ultra-hard body and substrate each having a grooves positioned adjacent the interface, it is to be understood that the use of side surface features other than grooves that can function to provide angles of departure $\theta_1$ and $\theta_2$ of less than 90 degrees are understood to be within the scope of this invention.

In an example embodiment, it is desired that the angles of departure $\theta_1$ and $\theta_2$ can be within the range of from about 3 to 87 degrees, preferably in the range of from about 30 to 85 degrees, and more preferably in the range of from about 45 to 75 degrees. It is to be understood that the exact angle of the angles of departure $\theta_1$ and $\theta_2$ can and will vary depending on the types of materials used to form both the ultra-hard body and substrate, the types of materials that are used to join the ultra-hard body and substrate together, and the particular end-use application. In such example embodiment, the flared regions 98 and 104 have an_angled exterior profile. Alternatively, the flared regions can have a radiused exterior profile.

A feature of cutting elements prepared according to principles of the invention is that they have been specifically engineered to have reduced stress or stress singularity at the interface free edge by reducing one or both of the angles of departure $\theta_1$ and/or $\theta_2$ to less than 90 degrees. In a preferred embodiment, the ultra-hard body, e.g., comprising PCD or TSP, is configured having an angle of departure $\theta_1$ that is acute or less than 90 degrees. The substrate, e.g., formed from a cermet material such as WC—Co, can be configured such that it has an angle of departure $\theta_2$ that is acute, i.e., less than 90 degrees or blunt, i.e., greater than 90 degrees.

Additionally, interlayer or intermediate materials, e.g., braze materials or the like that are or can be used to join the body and substrate together, can also be used in conjunction with the above-noted geometric features to achieve a desired reduction in stress singularity. Such intermediate materials can be selected to have mechanical and/or thermal properties that are intermediate the body and substrate, thereby acting to buffer the mechanical and/or thermal differences between the body and substrate during operation, thereby operating to reduce stress singularity.

FEA analysis can be used to optimize such features as the materials selected for forming the body and substrate, the geometry of the interface between the body and substrate adjacent the interface free edge, and the selection of appropriate interlay materials that can be used in a braze joint.

Cutting elements prepared according to principles of this invention can be used in a number of different applications, such as tools for mining, cutting, machining and construction applications, where the combined mechanical properties, thermal properties, and reduced stress singularity are highly desired. Such cutting elements are particularly well suited for forming working, wear and/or cutting components in machine tools and drill and mining bits such as fixed blade cutters.

Figure 5:
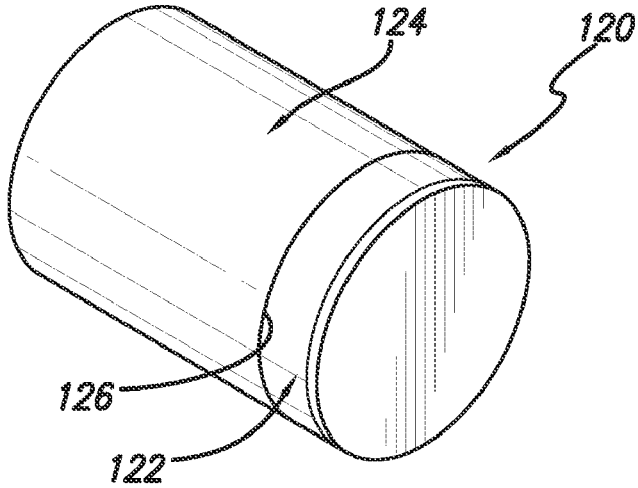
FIG. 5 is a perspective side view of a cutting element provided in the form of a shear cutter.

FIG. 5 illustrates a cutting element of this invention as embodied in the form of a shear cutter 120 used, for example, with a drag bit for drilling subterranean formations. The shear cutter 120 comprises an ultra-hard body 122 that is attached to a cutter substrate 124 along an interface or braze joint 126. The shear cutter 120 is configured having one or both angles of departure $\theta_1$ and $\theta_2$ that are less than 90 degrees from the interface as measured relative to a side surface. It is to be understood that FIG. 5 illustrates a single embodiment of a cutting element configured in the form of a shear cutter having a particular configuration, and that cutting elements can be configured as shear cutters having different geometries and that the same are intended to be within the scope of this invention.

Figure 6:
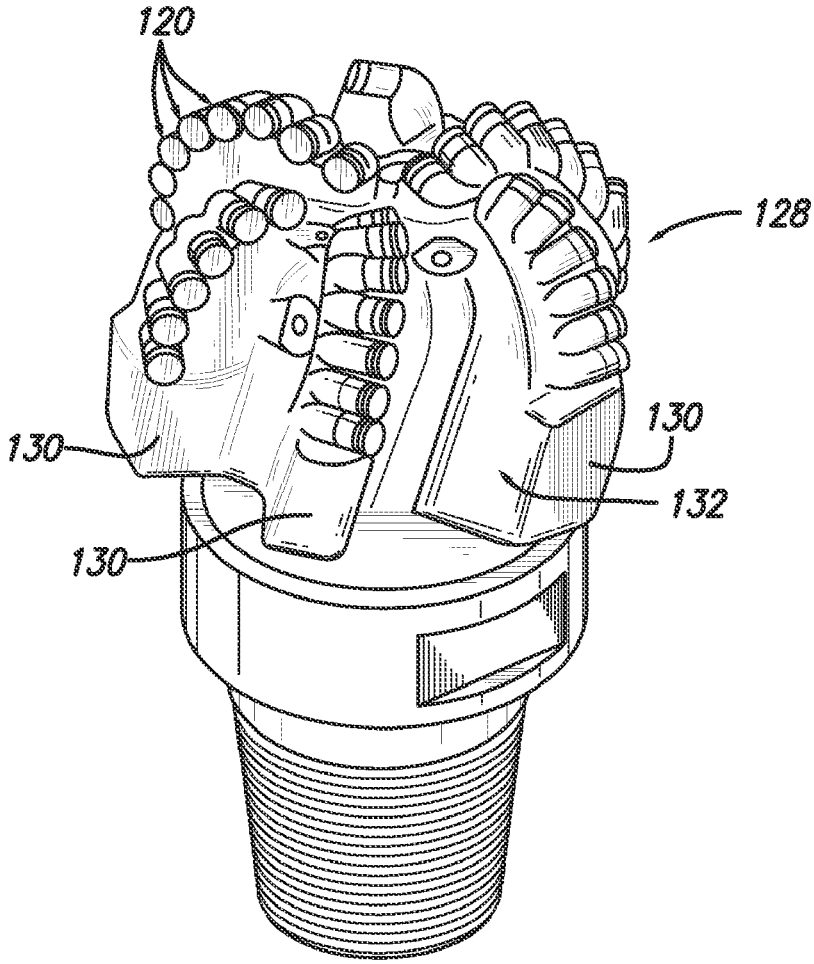
FIG. 6 is a perspective side view of a drag bit comprising a number of the shear cutters of FIG. 5.

FIG. 6 illustrates a drag bit 128 comprising a plurality of the shear cutters 120 described above and illustrated in FIG. 5. The shear cutters are each attached to blades 130 that extend from a body or head 132 of the drag bit for cutting against the subterranean formation being drilled.

Other modifications and variations of cutting elements comprising reduced stress singularity will be apparent to those skilled in the art. For example, while embodiments of cutting elements have been described as illustrated as comprising an ultra-hard body and a substrate, it is to be understood that cutting elements within the scope of this invention can include materials other than those described above that have different mechanical and/or thermal properties so that when joined together produce stress during operation at the interface free edge.

Accordingly, cutting elements prepared according to principles of this invention are not limited to embodiments where the body is formed from an ultra-hard material and the substrate is formed from those materials described above. It is, therefore, to be understood that within the scope of the appended claims, this invention may be practiced otherwise than as specifically described.

What is claimed is:

1. A bit for drilling subterranean formations, the bit comprising:

a body; and a plurality of cutting elements disposed onto the bit and comprising:

an ultra-hard body formed from a material selected from the group consisting of diamond, polycrystalline diamond, thermally stable polycrystalline diamond, cubic boron nitride, polycrystalline cubic boron nitride, and combinations thereof; and a substrate attached to the ultra-hard body and being formed from a material having different mechanical or thermal properties than that of the ultra-hard body;

wherein an interface exists between the body and the substrate, and wherein the cutting element has an angle of departure as measured inside the cutting element between the interface and an outer side surface feature of both the body and substrate adjacent the interface that is less than about 90 degrees, and wherein the outer side surface feature of the body is exposed and free to contact a subterranean formation being drilled when the bit is placed into use.

2. The bit as recited in claim 1 wherein an outer side surface of the body is contoured adjacent the interface to provide the angle of departure within the body of less than about 90 degrees.

3. The bit as recited in claim 2 wherein an outer side surface of the substrate is contoured adjacent the interface to provide the angle of departure within the substrate of less than about 90 degrees.

4. The bit as recited in claim 1 wherein an outer side surface of the substrate is contoured adjacent the interface to provide the angle of departure within the substrate of less than about 90 degrees.

5. The bit as recited in claim 1 wherein the outer side surface features are grooves disposed within the cutting element and positioned circumferentially therearound.

6. The bit as recited in claim 1 wherein the angle of departure is in the range of from about 45 to 75 degrees.

7. A bit for drilling subterranean formations comprising:

a body and a number of blades projecting outwardly from the body, wherein the blades include one or more cutting elements attached thereto, wherein the cutting elements comprise:

an ultra-hard body formed from a material selected from the group consisting of diamond, polycrystalline diamond, thermally stable polycrystalline diamond, cubic boron nitride, polycrystalline cubic boron nitride, and combinations thereof;

a substrate that is attached to the ultra-hard body and that is formed from a material having different mechanical or thermal properties than that of the ultra-hard body;

wherein an interface exists between the body and the substrate, and wherein the cutting element has an angle of departure as measured within the cutting element between the interface and a free edge of the cutting element in both of the body and substrate that is less than about 90 degrees; and wherein the angle of departure is provided by a surface feature positioned along an outer side surface of both of the body and the substrate adjacent the interface, and wherein the surface feature on the body is exposed and free to contact a subterranean formation being drilled when placed into use.

8. A cutting element comprising:

an ultra-hard body formed from a material selected from the group consisting of diamond, polycrystalline diamond, thermally stable polycrystalline diamond, cubic boron nitride, polycrystalline cubic boron nitride, and combinations thereof;

a substrate attached to the ultra-hard body and formed from a material having different mechanical or thermal properties than that of the ultra-hard body;

wherein an interface exists between the body and the substrate, and wherein the ultra-hard body has an angle of departure as measured within the cutting element between the interface and an outer side surface of the ultra-hard body adjacent the interface that is less than about 90 degrees; and wherein the substrate has an angle of departure as measured within the cutting element between the interface and an outer side surface of the substrate adjacent the interface that is less than about 90 degrees.

9. A bit for drilling subterranean formations comprising:

a body and a number of blades projecting outwardly from the body, wherein the blades include one or more cutting elements attached thereto, wherein the cutting elements comprise:

an ultra-hard body formed from a material selected from the group consisting of diamond, polycrystalline diamond, thermally stable polycrystalline diamond, cubic boron nitride, polycrystalline cubic boron nitride, and combinations thereof;

a substrate that is attached to the ultra-hard body and that is formed from a material having different mechanical or thermal properties than that of the ultra-hard body;

wherein an interface exists between the ultra-hard body and the substrate, and wherein the cutting element has an angle of departure as measured within the cutting element between the interface and an outer side surface of the ultra-hard body adjacent the interface that is less than about 90 degrees; and wherein the cutting element has an angle of departure as measured within the cutting element between the interface and an outer side surface of the substrate adjacent the interface that is less than about 90 degrees.

10. The bit as recited in claim 1 wherein the interface is substantially linear extending between the body and substrate to an outside side surface of the cutting element.

11. The bit as recited in claim 7 wherein the interface is substantially linear extending between the body and substrate to an outside side surface of the cutting element.

12. The cutting element as recited in claim 8 wherein the interface is substantially linear extending between the body and substrate to an outside side surface of the cutting element.

13. The bit as recited in claim 9 wherein the interface is substantially linear extending between the body and substrate to an outside side surface of the cutting element.

* * * * *